US005507618A

United States Patent [19]

Kubo et al.

[11] Patent Number: 5,507,618

[45] Date of Patent: Apr. 16, 1996

[54] PACKAGE-TYPE OIL-COOLED AIR COMPRESSOR

[75] Inventors: Kazuo Kubo; Koji Akashi; Keitaro Ishikawa, all of Hyogo, Japan

[73] Assignee: Kabushiki Kaisha Kobe Seiko Sho, Kobe, Japan

[21] Appl. No.: 418,446

[22] Filed: Apr. 7, 1995

[30] Foreign Application Priority Data

Apr. 8, 1994 [JP] Japan ..... 6-070528

[51] Int. Cl.[6] ..... F01D 25/14

[52] U.S. Cl. ..... 415/182.1; 417/372; 165/47

[58] Field of Search ..... 415/182.1; 417/372, 417/310; 165/47

[56] References Cited

U.S. PATENT DOCUMENTS

| | | | |
|---|---|---|---|
| 4,492,533 | 1/1985 | Tsuge | 417/372 |
| 4,585,398 | 4/1986 | Drake | 417/372 |
| 4,902,226 | 2/1990 | Elliott et al. | 417/372 |
| 4,976,098 | 12/1990 | Meyer et al. | 165/47 |
| 5,151,016 | 9/1992 | Her | 417/372 |
| 5,240,648 | 8/1993 | Gill et al. | 417/372 |

*Primary Examiner*—John T. Kwon

*Attorney, Agent, or Firm*—Oblon, Spivak, McClelland, Maier, & Neustadt

[57] ABSTRACT

This invention provides a package-type oil-cooled air compressor in which the housing is divided into two chambers, in one of which, a first chamber, are located the compressor unit, motor used to drive the compressor unit, air intake filter and intake regulator valve connected to the compressor unit, and in the other of which, a second chamber, are located the oil cooler and sirocco fan. An air duct connects the two chambers. Air outlets are formed in each of the chambers and an air inlet is formed in the second chamber. Air is introduced through the rotation of the sirocco fan into the second chamber via the air inlet. A portion of this air is directed into the first chamber via the air duct where a part is used to supply the compressor unit and the remainder flows over the components located in the first chamber to cool them and leaves via the outlet formed in the first chamber. The air that is not directed into the first chamber via the duct leaves the outlet formed in the second chamber after flowing over the oil cooler.

4 Claims, 3 Drawing Sheets

PACKAGE-TYPE OIL-COOLED AIR COMPRESSOR

FIELD OF THE INVENTION

This invention relates to a package-type oil-cooled air compressor in which each component of the compressor unit etc. is enclosed within a housing.

DESCRIPTION OF THE PRIOR ART

Package-type oil-cooled air compressors of the type shown in FIGS. 5 and 6 are known in the prior art. The compressor shown in FIG. 6 is disclosed in Japanese Unexamined Patent Publication No. Hei 1-313694.

In the compressor shown in FIG. 5, a compressor unit 2; an intake unit connected to the compressor unit 2 and comprising an intake filter 3 and an intake adjustment valve 4; an exhaust unit also connected to the compressor unit and comprising an oil separator 5, an after cooler (not shown) and an air tank 6; an oil supply line (not shown) leading from a oil collector (not shown) located at the bottom of the oil separator via oil cooler 8 to bearings, axis housing and rotor housing of the compressor unit 2; a motor 9 positioned above the compressor unit 2 and the intake unit for driving the screw rotor (not shown) of the compressor unit via a belt and pulley(s); and a sirocco fan (10) fixed above the output shaft of the motor 9 for ventilation purposes, are all installed inside housing 1.

A large air intake path 11 leading from an opening in the bottom left hand corner and extending upwards to open into the housing chamber in which the compressor unit etc. is installed is also provided. Also, an air exhaust path 12*a*, 12*b* which leads from this housing chamber, via oil cooler 8 and then extends upwards via sirocco fan 10 to an opening in the top left hand comer is also provided. Furthermore, a space connected to the exhaust path 12*a* is formed in the area of the output shaft of the sirocco fan 10.

With this compressor, air is drawn into the housing chamber in which the compressor unit 2 etc. is installed via intake path 11 through the action of sirocco fan 10. A portion of this air is then drawn into compressor unit 2 via intake filter 3 and intake adjustment valve 4 where it is then compressed and directed to the oil separator unit 5 where the oil and air are separated. Then the compressed air is delivered to the user via an after cooler and air tank 6. The oil separated in the oil separator is recirculated to the bearings, shaft housing and rotor housing of compressor unit 2.

A portion of the air drawn into casing 1 via air intake path 11, cools those components installed in the housing chamber such as the compressor unit, goes on to pass through the oil cooler where it cools the oil contained therewithin, and is thereafter directed to the outside of the casing via air exhaust path 12*a*, 12*b*.

The compressor shown in FIG. 6 is divided into two chambers by a dividing wall 22. A compressor unit 23, a motor 24 used to drive the screw rotor (not shown) inside the compressor unit via pulley and belt, and an oil separator (not shown) are all installed in the fight hand chamber. In the left hand chamber, an after cooler 26 and an oil tank are positioned so as to be in line with the sirocco fan 25 fixed to the output shaft of motor 24, and the opening formed in the left hand wall of the housing 21. Furthermore, an air inlet 28 is formed in the lower portion of the right hand wall of the housing, and a through hole (not shown) is formed in dividing wall 22 to let air flow from the right hand chamber to the left hand chamber.

This compressor operates in essentially the same way as the compressor shown in FIG. 5 to deliver compressed air and effect oil recirculation.

However with this compressor, the air drawn into air inlet 28 through the action of the fan and sirocco fan fixed to motor 24, cools the components inside the right hand chamber and is directed to the left hand side chamber. Also, air is drawn from outside into the left hand side chamber via after cooler 26 and oil cooler 27 through the action of sirocco fan 25. This air acts to cool the compressed air and oil located within these components. The air drawn through these components is then directed to the outside of the housing from an opening located above the sirocco fan.

In the case of the compressor shown in FIG. 5, the air drawn in via air intake path 11 passes several places of high noise production such as the motor 9 and compressor unit 5, and is then all expelled to the outside of the housing 1. As a consequence, there is a problem that the amount of noise leaking to the outside of the housing 1 is high. Furthermore, since all the air drawn into the housing flows towards the oil cooler 8 and the air tank 6 is positioned in the path of the air to the oil cooler 8, there exists the problem that the air tank is overcooled causing water etc. to collect in the tank which can cause rusting etc.

In the case of the compressor shown in FIG. 6, there is the problem that a high amount of noise generated by the motor 24 and compressor unit 23, passes through the through hole formed in the dividing wall, passes via the sirocco fan, and leaks to the outside of the housing from the opening located towards the top or from the openings near the after cooler 26 and oil cooler 27.

Also, in the case of either of the above described compressors, the air inside the casing (1, 21) which experiences thermal expansion through heating by the compressor unit 4, 23 and motor 9, 24 is drawn into compressor unit 3, 24 at atmospheric pressure via intake filter 3 and intake adjustment valve 4. As a result, there arise the problems that the amount of air expelled from the compressor unit 4, 23 is decreased and the exhaust temperature is increased.

This invention was made in light of the problems in the prior art compressors and has as its objective the provision of a package-type oil-cooled air compressor in which increases in the noise reduction and the amount of exhaust air, and decreases in the exhaust temperature have been made possible.

SUMMARY OF THE INVENTION

The package-type oil-cooled air compressor according to the present invention comprises; a housing which is divided into at least two chambers, a first and second chamber, by a partition wall; a compressor unit located in said first chamber, an inlet filter and an intake adjustment valve located in said first chamber and connected to the inlet of said compressor unit; an aftercooler and oil separator located in either said first or second chambers and connected to the outlet of said compressor unit; an oil cooler located in said second chamber; an oil line connecting the lower oil collecting section of said oil separator to the bearings, shaft sleeve and rotor housing of said compressor unit via said oil cooler; an actuator located in said first chamber for driving said compressor unit; a fan located in said second chamber; an air inlet formed in the wall of said second chamber; an air duct connecting said first and second chambers; a first air outlet formed in the wall of said first chamber; and a second air outlet formed in the wall of said second chamber.

In the compressor of the present invention, the major noise sources, namely the motor and the compressor unit are located in a chamber largely isolated off by the partition wall, and also with the construction of the compressor of this invention it is sufficient to direct only the necessary minimum amount of air to the noise sources located in the first chamber, thus making it possible to reduce the size of the air passages in which the air in the first chamber flows, and therefore the amount of noise leaking to the outside of the compressor housing can be reduced. As a result, it is possible to decrease the size of muffler used together with the compressor, and as mentioned above, since the size of the air passages in the first chamber can be reduced in size, the size of the compressor as a whole can be reduced.

Furthermore, since, as mentioned above, only the necessary minimum amount of air is directed to the first chamber containing the motor, compressor unit etc, there is no risk of the compressor unit etc. overcooling, and the production of drain water can be controlled.

In a preferred embodiment of the present invention the air duct leading from the second chamber to the first chamber is extended to envelop the air intake filter, such that air is supplied directly thereto. As a result, cold air at a pressure higher than atmosphere pressure is supplied to the air intake filter, and it is possible to thereby increase the amount of, and reduce the temperature of, the compressed air produced by the compressor unit.

In other preferred embodiments of the present invention, components such as a plate, or curved tube section are fitted to the air duct at the point where it opens into the second chamber, thus making it possible to further control the amount of air, as a proportion of the total amount of air introduced into the housing through the air inlet, that is directed into the first chamber via the air duct.

[DESCRIPTION OF THE EMBODIMENTS]

Figure 1:
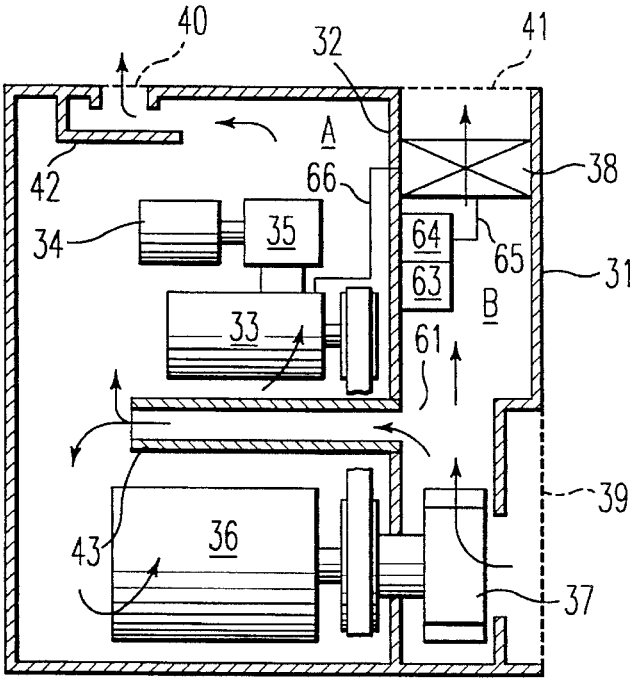
FIG. 1 is a generalized cross-sectional diagram of a package-type oil cooled air compressor according to first embodiment of the present invention.

FIG. 1 shows a package-type oil-cooled air compressor eg. a screw type compressor, according to a first embodiment of the present invention. The inside of the casing 31 is divided into two chambers by a dividing wall 32. In one chamber (chamber A) are installed the following: a compressor unit 33; an intake unit connected to the compressor unit 33 and comprising an intake filter 34 and an intake adjustment valve 35; an exhaust unit connected to the compressor unit 33 and comprising an after cooler 63 and an oil separator 64; and a motor (i.e., actuator) 36 positioned below the compressor unit 33 and which drives the rotor eg. screw rotor, of the compressor unit 33 via a belt and pulley. In the other chamber (chamber B) the following are installed horizontally: a sirocco fan 37 which is connected to the output shaft of the motor 36 extending through the dividing wall 32; and an oil cooler 38 which is positioned above the sirocco fan 37. The oil cooler 38 is installed in an oil supply line 65, 66 which extends from the oil collector located in the bottom of the oil separator to the shaft sleeve and rotor housing of the compressor unit 33.

Furthermore, an air inlet 37 is formed in the housing side wall located to the right of the sirocco fan; a first air outlet 40 is formed towards the top of chamber A (in this embodiment in the top face of the housing 31); and a second air outlet 41 is formed towards the top of chamber B (in this embodiment in the top face of chamber B above oil cooler 38). Also, a sound deflection plate 42 is installed beneath first air outlet 40.

In addition, a duct 43 is installed in housing 31 for directing air drawn into the housing by sirocco fan 37 into chamber A, and more preferably to the lower portion of motor 36 and close to intake filter 34.

One portion of the air drawn into the housing 31 through the action of sirocco fan 37 flows into duct 43, the remaining portion flows towards the oil cooler 38. A portion of the air that has entered duct 43 flows towards intake filter 34 and the remainder flows towards the lower part of the motor 36. The air flowing towards oil cooler 38 passes there through to cool the oil circulating between the oil cooler 38 and the compressor unit 33, and then leaves the housing 31 from second air outlet 41.

The air that flows to intake filter 34 and intake adjustment valve 35 via duct 43 is compressed whilst being oil cooled in compressor unit 33, and is supplied to the user via an exhaust unit comprising an after cooler and an oil separator.

The air flowing to the lower portion of motor 36 acts to cool motor 36, compressor unit 33, and the belt etc. used to effect transmission of drive between these two, and then exits the housing via first air outlet 40.

Chamber B is separated from chamber A by dividing wall 32 and the amount of noise generated by motor 36 and compressor unit 33 leaking through duct 43 to chamber B is very small. Also, since the amount of noise generated by sirocco fan 37 itself is very small, the amount of noise leaking through air inlet 39 and second air outlet 41 is small. Also, although there is a gap formed between the rotor shaft of the sirocco fan 37 and the dividing wall 32, this gap is very small and thus very little noise leaks therefrom.

Furthermore, since the amount of air passing from air duct 43 to the first air outlet 40 via the lower part of the motor 36 is very small compared to the amount of air flowing from air inlet 39 to oil cooler 38, and due to the effect of the sound deflection plate, very little noise leaks through first air outlet 40.

As a result, the amount of noise leaking to the outside of the package as a whole is small, and thus it is possible to employ a smaller noise reduction unit. Also, since only that amount of air necessary to cool the motor 36, compressor unit 33 etc. flows into first chamber A, i.e. air for cooling the oil cooler 38 does not flow through first chamber A, it is possible to reduce the size of the air passages inside first chamber A. Accordingly, reduction in size and weight of the compressor as a whole is possible. Furthermore, since no more than the minimum amount of air necessary for cooling flows into first chamber A, there is no overcooling of the compressor unit 33, oil separator etc. and drain production can be controlled.

Figure 2:
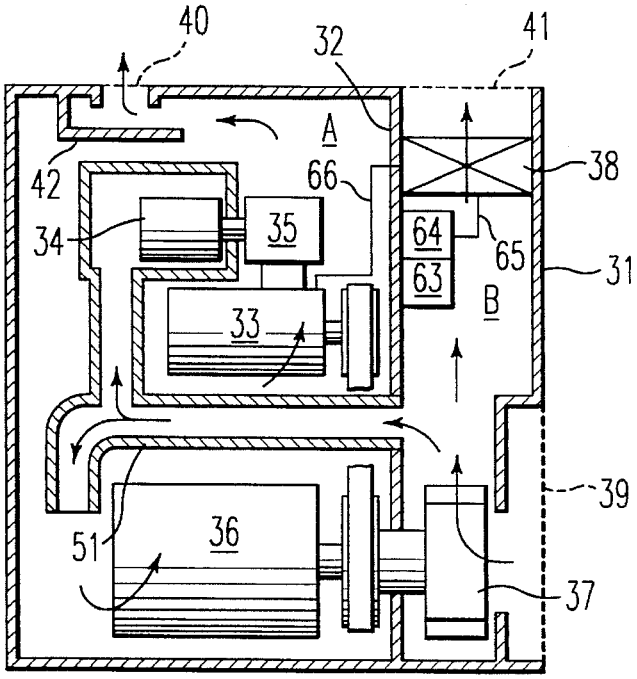
FIG. 2 is a generalized cross-sectional diagram of a package-type oil cooled air compressor according to a second embodiment of the present invention.

FIG. 2 shows a second embodiment of the package-type oil-cooled air compressor according to the present invention. It is substantially similar to the compressor shown in FIG. 1 except that duct 43 is replaced by duct 51, and thus common components shall be assigned the same reference numbers and a detailed explanation thereof shall be omitted.

Duct 51 is forked into two passages at a position below intake filter 34. One of the passages extends to envelop the intake filter 34, and the other extends towards the lower part of the motor 36. With this construction, since air is supplied by sirocco fan 37 via duct 51 to intake filter 34 at a positive pressure, and is relatively cool as a result of being supplied directly to air intake filter 34, the amount of exhaust air from compressor unit 33 is increased and the temperature of the exhaust air is decreased.

Also, since the required amount of cold air is directed to the lower part of the motor 36 from air duct 51, and flows via the area of the compressor unit 33 towards first air outlet 40, the cooling of the motor is effected efficiently.

Figure 3:
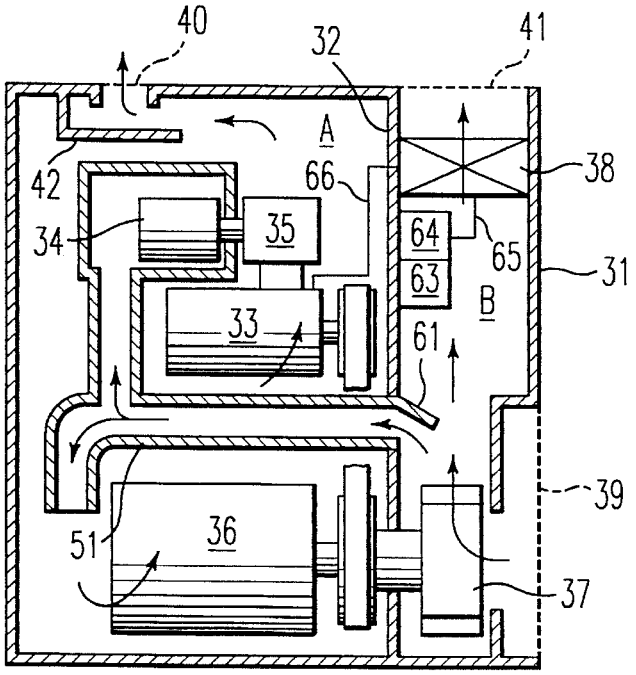
FIG. 3 is a generalized cross-sectional diagram of a package-type oil cooled air compressor according to a third embodiment of the present invention.

FIG. 3 shows a third embodiment of the package-type oil-cooled compressor according to the present invention. It is substantially similar to the compressor shown in FIG. 2 except that a guide plate 61 is fixed to the inlet of the duct 51, and thus common components shall be assigned the same reference numbers and a detailed explanation shall be omitted. The guide plate 61 facilitates the flow into duct 51 of a portion of the air supplied from sirocco fan 37, and by adjusting the size and angle of the guide plate 61, a specified amount of air can be directed into first chamber A, and it is thus possible to improve the operation of the compressor in comparison with the compressor of the first and second embodiments.

Figure 4:
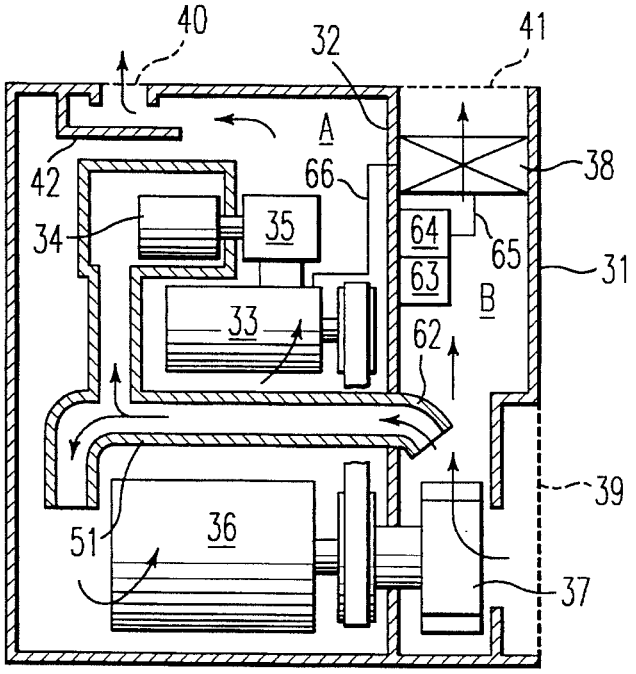
FIG. 4 is a generalized cross-sectional diagram of a package-type oil cooled air compressor according to a fourth embodiment of the present invention.
Figure 5:
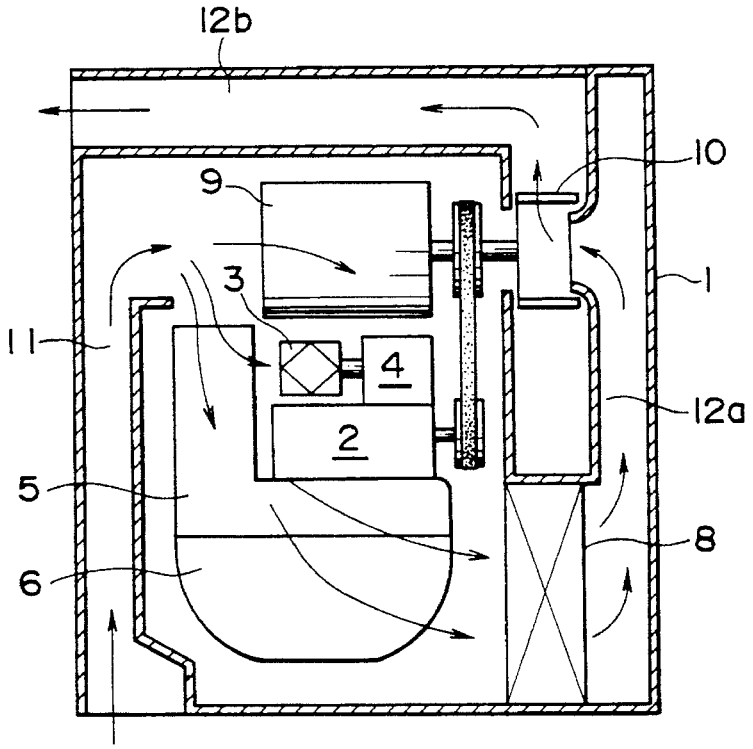
FIG. 5 PRIOR ART
FIG. 5 is a generalized cross-sectional diagram of a prior art package-type oil cooled air compressor.
Figure 6:
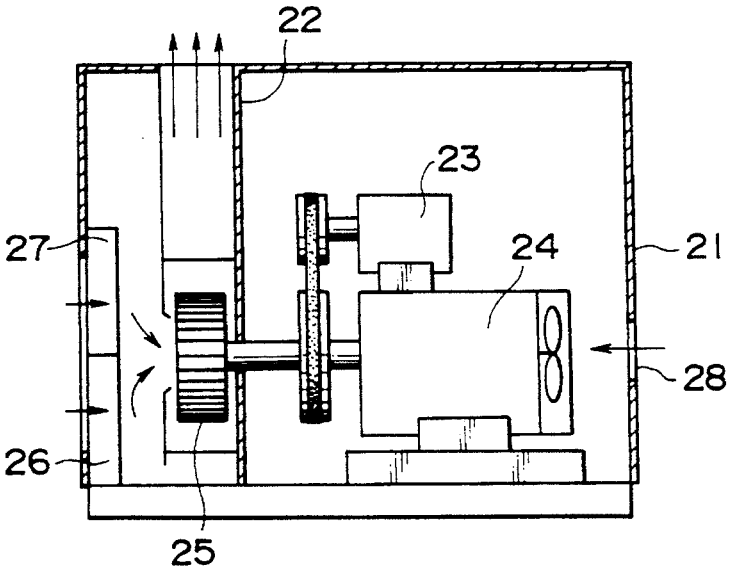
FIG. 6 PRIOR ART
FIG. 6 is a generalized cross-sectional diagram of another prior art package-type oil cooled air compressor.

FIG. 4 shows a fourth embodiment of the package-type oil-cooled air compressor according to the present invention. It is substantially similar to the compressor shown in FIG. 2 except that a curved duct extension section (62) extending in the down direction is fixed to the inlet of the duct 51, to achieve the same kind of air-directing effect as achieved with the above-described third embodiment.

What is claimed is:

1. A package-type oil-cooled air compressor comprising:

(i) a housing;

(ii) a separating wall dividing said housing into a first chamber and a second chamber;

(iii) a compressor unit located in said first chamber;

(iv) an inlet filter and an intake adjustment valve located in said first chamber and connected to the inlet of said compressor unit;

(v) an aftercooler and oil separator located in either said first or second chambers and connected to the outlet of said compressor unit;

(vi) an oil cooler located in said second chamber;

(vii) an oil line connecting the lower oil collecting section of said oil separator to the bearings, shaft sleeve and rotor housing of said compressor unit via said oil cooler;

(viii) an actuator located in said first chamber for driving said compressor unit;

(ix) a fan located in said second chamber for driving the flow of air through said housing;

(x) an air inlet formed in the wall of said second chamber through which air is drawn into said housing through the action of said fan;

(xi) an air duct connecting said first and second chambers;

(xii) a first air outlet formed in the wall of said first chamber through which air drawn into said first chamber via said air duct leaves said housing; and (xiii) a second air outlet formed in the wall of said second chamber above said fan, through which air passing over said oil cooler leaves said housing.

2. The package-type oil-cooled oil compressor according to claim 1 wherein said air duct extends to envelop said inlet filter of said first chamber.

3. The package-type oil-cooled air compressor according to claim 1 wherein the section of said air duct opening into said second chamber has a plate attached thereto, for directing air into said air duct.

4. The package-type oil-cooled air compressor according to claim 1 wherein the section of said air duct opening into said second chamber comprises a curved tube section pointing in the direction of said air inlet, for directing air into said air duct.

* * * * *